United States Patent [19]

Petrachkoff

[11] Patent Number: 5,062,613

[45] Date of Patent: Nov. 5, 1991

[54] TWO SPEED HOIST DRIVE ASSEMBLY

[75] Inventor: Peter Petrachkoff, Salem, Ohio

[73] Assignee: Fordees Manufacturing, Leetonia, Ohio

[21] Appl. No.: 620,708

[22] Filed: Dec. 3, 1990

[51] Int. Cl.[5] ..... C21B 13/00; C21C 5/30

[52] U.S. Cl. ..... 266/44; 266/226

[58] Field of Search ..... 266/44, 225, 226; 75/553

[56] References Cited

U.S. PATENT DOCUMENTS 4,198,035 4/1980 Smejkal et al. ..... 266/226

4,792,124 12/1988 Zonneveld ..... 266/226

FOREIGN PATENT DOCUMENTS 1397494 5/1988 U.S.S.R. ..... 266/226

*Primary Examiner*—Melvyn J. Andrews

*Attorney, Agent, or Firm*—Clifford A. Poff

[57] ABSTRACT

A BOF sublance hoist system including a two speed hoist drive for rapidly moving the sublance through a non-critical distance above the molten metal bath within the BOF and then slowly moving the sublance through a critical spotting distance for enabling safe insertion and withdrawal of the sublance into and from the bath. The drive includes a first electric motor for rapid movement, a second electric motor for the slower movement and an emergency air motor to be used in place of the second motor in the event of electrical power failure. When the first motor is in operation, the second motor is shut off and its brake is set. The reverse is true for times when the second motor is operating. A planetary gear system which is driven internally by the first motor and externally by the second motor serves as the gear reducer for permitting power transmission to the hoist drum to be achieved through operation of either the first, second or third motor. The system further includes means for seizing a carriage which supports the sublance should a free-fall of the carriage be detected.

18 Claims, 8 Drawing Sheets

TWO SPEED HOIST DRIVE ASSEMBLY

BACKGROUND OF THE INVENTION

1. Field of the Invention

The present invention relates generally to apparatus for hoisting and, more particularly, to apparatus for safely lowering and raising a sublance into and out of a basic oxygen furnace (BOF) vessel.

2. Description of the Prior Art

Heretofore, a number of systems have been introduced for manipulating various equipment, e.g., oxygen blow lances and the like, relative to a BOF vessel. These systems include for lowering and raising the equipment into and out of the vessel and normally also include means for transporting the systems to and from a "ready" position located above the BOF vessel. Typical examples of such systems are found in U.S. Pat. No. 2,822,163 to McFeaters; U.S. Pat. No. 3,022,990 to McFeaters et al.; U.S. Pat. No. 3,412,989 to Penn and U.S. Pat. No. 4,198,035 to Smejkal et al. Each of these patents disclose the use of a single, reversible (usually electric) motor for lowering and raising oxygen lances into and out of a BOF vessel. Due to the magnitudes of the loads normally moved by these motors, e.g., several tons, the motors must be large and must be operated at relatively high speed in order to create the torque necessary to overcome the high inertia of the motors themselves, their drive systems and the load being hoisted. Consequently, these motors are most effectively operated at or above a critical and relatively high speed. Hence, the loads moved thereby can only be translated at relatively high speed.

U.S. Pat. No. 3,149,191 to McFeaters et al. is to a BOF system layout including an apparatus used to raise and lower an oxygen blow lance. The vertical movement of the lance is effected in a two-stage manner by operation of a single reversible electric motor. In order to raise the lance, the electric motor is operated so as to turn a winding drum in a first direction which in turn moves a cable, which is entrained over a block and tackle pulley system and whose opposite ends are attached to the top and bottom of a lance holding carriage, within a movable guide extension carriage until an upper cable anchor abuts a pulley. At this point, continued turning of the winding drum by the motor causes the movable guide extension carriage to raise within stationary guide channels until it reaches the desired elevation whereupon the motor is deactivated. To lower the lance, the direction of turning of motor is reversed and so too are the stages of the lifting operation. Furthermore, because of the block and tackle arrangement created by the pulley system, the lance moves slowest through its regions of highest elevation wherein the block and tackle come into play. Conversely, when the movable guide extension carriage is in its lowest position, the block and tackle arrangment is no longer a factor. Below this point, the movement of the lance holding carriage is fastest since the opposite ends of the cable are permitted to freely translate in direct relation to the turning of the winding drum. That is, there is no lost motion in the carriage translation caused by the block and tackle arrangement when the movable guide extension is in its lowest position.

In U.S. Pat. No. 3,763,704 to Blau et al. there is disclosed an oxygen lance and a sublance which are carried on the same vertically reciprocable carriage whose translation is effected by a hoist. The sublance is vertically translatable relative to the oxygen lance by a second motor and a chain system carried by the carriage. There is no mention in this reference of any preferred relative hoisting speeds of the hoist motor and the second motor.

U.S. Pat. No. 3,896,674 to Kolb discloses the use of a bath sensing probe which is raised and lowered into and out of a BOF vessel by reversible air motor. When the probe is lowered to the desired depth within the vessel, a sensor carried by the probe is caused to extend into the liquid steel bath through operation of a double acting air cylinder.

And, U.S. Pat. No. 4,792,124 to Zonneveld teaches to raise and lower a sublance by conventional means and to also provide the sublance with a helical guide system for imparting rotation to the sublance during raising and lowering thereof.

The lance elevating systems disclosed in each of the aforenoted patents, whether they are expressly designated for lowering and raising sublances into and out of a BOF vessel (as in U.S. Pat. Nos. 3,896,674 and 4,792,124), whether they are expressly designated for lowering and raising an oxygen blow lance into and out of the BOF vessel (as in U.S. Pat. Nos. 2,822,163; 3,022,990; 3,149,191; 3,412,989 and 4,198,035), or whether they are designated for hoisting both an oxygen blow lance and a sublance (as in U.S. Pat. No. 3,763,704), fail to describe systems which effectively maximize speed and safety in hoisting a sublance into and out of a BOF vessel.

In those patents mentioned hereabove wherein there is disclosed only single motor means for lowering and raising an oxygen blow lance into and out of a BOF, the lance, which is typically of uncomplicated and rugged construction, may be lowered at relatively rapid speed from a position well above the BOF to its desired elevation within the BOF. If the lance should happen to strike the molten metal bath within the BOF upon insertion thereinto, the lance would not likely be damaged because of its inherent durability. However, if a substantially more delicate sublance (which monitors bath temperature, composition, and the like, were rapidly lowered into the bath using similar elevating equipment, the sudden and drastic thermal shock would very likely cause damage to the sublance.

In addition, in the aforenoted patents wherein there is disclosed only single motor means for hoisting a sublance into and out of a BOF, there is provided no means for maximizing hoisting speed through a non-critical distance above the bath in order to maximize productivity yet also enabling relatively slow hoisting speed through a critical spotting distance in order to ensure safe insertion and withdrawal of the sublance into and out of the bath.

Furthermore, in U.S. Pat. No. 3,763,704 which includes means for hoisting both an oxygen blow lance and a sublance into and out of a BOF, there is no provision of a sublance hoisting system which is independent of the oxygen lance hoisting system for controlling the hoisting speed of the sublance so as to be relatively rapid through the non-critical distance above the bath for purposes of maximizing productivity and for controlling the hoisting speed of the sublance so as to be relatively slow through the critical spotting distance in order to safely insert and withdraw the sublance from the bath. By its being carried by the blow lance carriage, the sublance hoisting system taught by U.S. Pat.

No. 3,763,704 inherently exposes the sublance to potential damage if the sublance is rapidly and/or imprecisely lowered into the BOF vessel by the blow lance carriage.

It is, therefore, and object of the present invention to provide a system for hoisting a sublance into and out of a BOF vessel, such system being independent of the oxygen lance hoist system associated with the BOF, which controls the hoisting speed of the sublance so as to be relatively rapid through the non-critical distance above the molten metal bath within the BOF for purposes of maximizing productivity and further serving to control the hoisting speed of the sublance so as to be relatively slow through the critical spotting distance in order to enable safe insertion and withdrawal of the sublance into and from the bath.

It is a more particular object of the present invention to provide a two-speed hoisting system for a sublance including a first motor operatively connected with a planetary gear system for enabling high speed hoisting of a sublance through the non-critical distance above the metal bath and a second motor also operatively connected with the planetary gear system for enabling low speed hoisting of the sublance through the critical spotting distance for permitting safe insertion and withdrawal of the sublance into and from the bath.

It is a further object of the present invention to provide a cable tension sensor for detecting slack in the sublance carriage support cable, such sensor being connected to apparatus for seizing the sublance carriage in the event a slack cable or a "free-fall" condition of the sublance carriage is detected.

Still other objects and advantages of the present invention will become apparent in light of the attached drawings and written description of the invention presented herebelow.

SUMMARY OF THE INVENTION

The present invention provides a BOF sublance hoist system, such system being independent of the oxygen lance hoist system associated with the BOF, which includes a two speed hoist drive for rapidly moving the sublance through a non-critical distance above the molten metal bath within the BOF for purposes of maximizing productivity and for moving the sublance relatively slowly through the critical spotting distance for enabling safe insertion and withdrawal of the sublance into and from the bath. The two speed hoist drive comprises a first AC electric motor for rapid movement, a second AC electric motor for the slower movement and an emergency air motor to be used in place of the second motor in the event of electrical power failure. When the first motor is in operation, the second motor is shut off and its brake is set. The reverse is true when the second motor is operating. A planetary gear system is driven internally by the first motor and externally by the second motor and serves as a gear reducer for permitting power transmission to the sublance hoist drum to be achieved through operation of either the first, second, or third motor. The system further includes means for seizing a carriage which supports the sublance should hoist cable slack or a free-fall of the carriage be detected.

DESCRIPTION OF THE PREFERRED EMBODIMENTS

Figure 1:
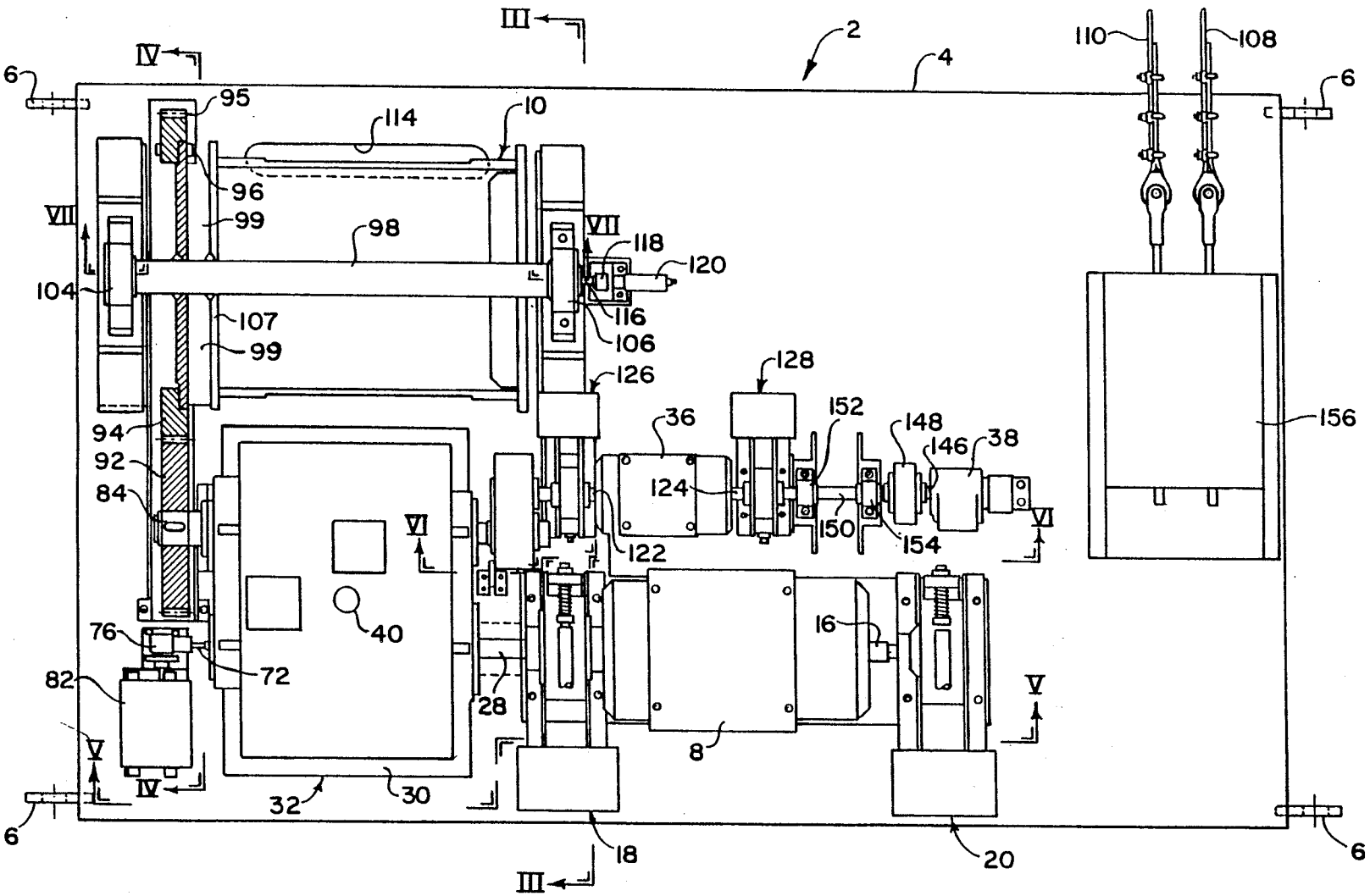
FIG. 1 is a partial section plan view of the two speed hoist drive system for a BOF sublance according to the present invention.

In FIG. 1 there is shown the two speed hoist drive system for a BOF sublance, herein designated by reference numeral 2, which is constructed in accordance with the preferred embodiment of the present invention.

Figure 13:
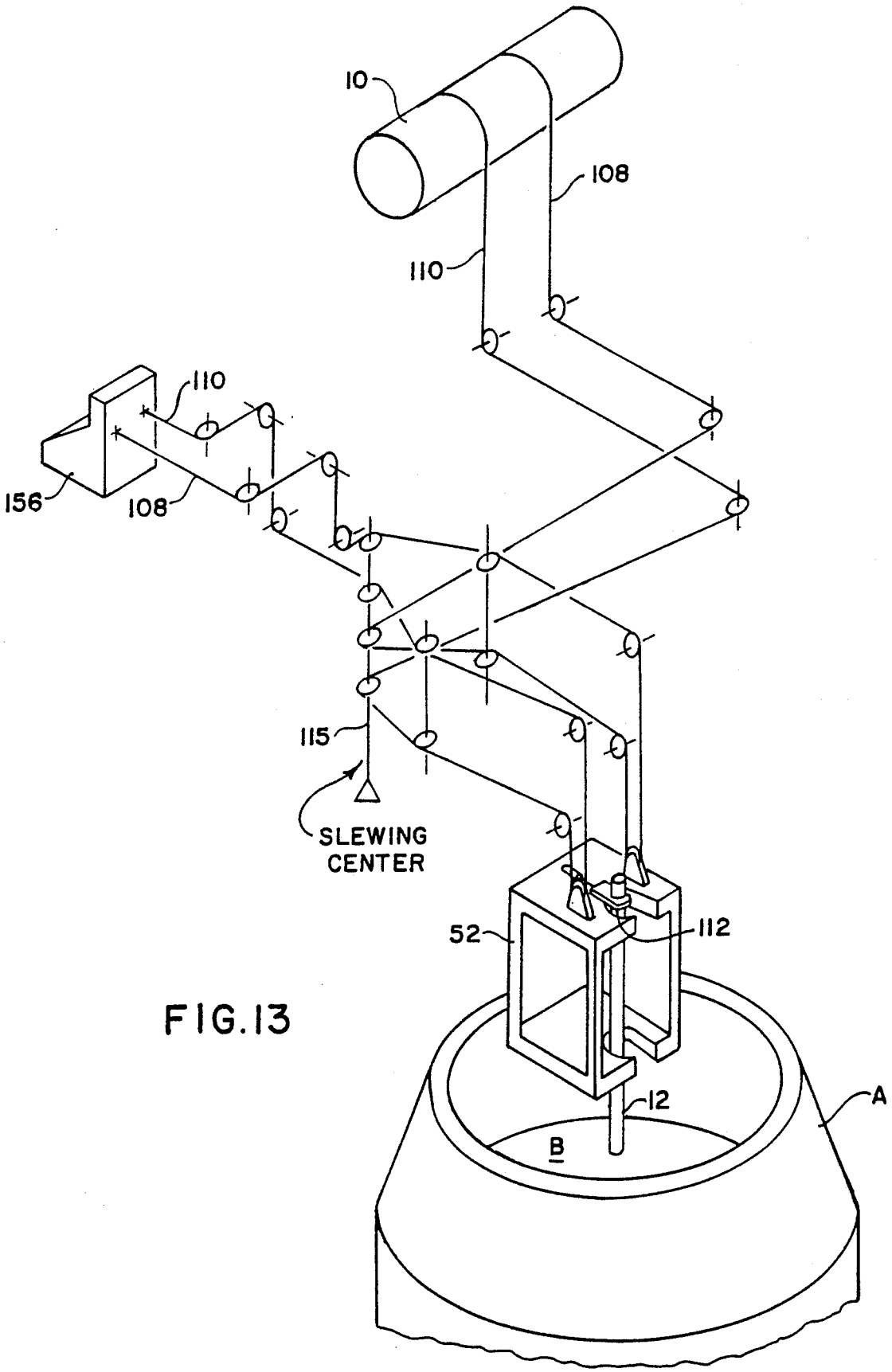
FIG. 13 is a schematic view of the preferred sublance carriage hoist cable layout to be used with the two speed hoist drive of the present invention.

The system 2 includes a platform 4 having grappling ears 6 enabling the platform to be grasped and slewed by suitable but unillustrated equipment between "ready" and "standby" positions above a BOF vessel A, the open top of which is represented schematically in FIG. 13.

Figure 2:
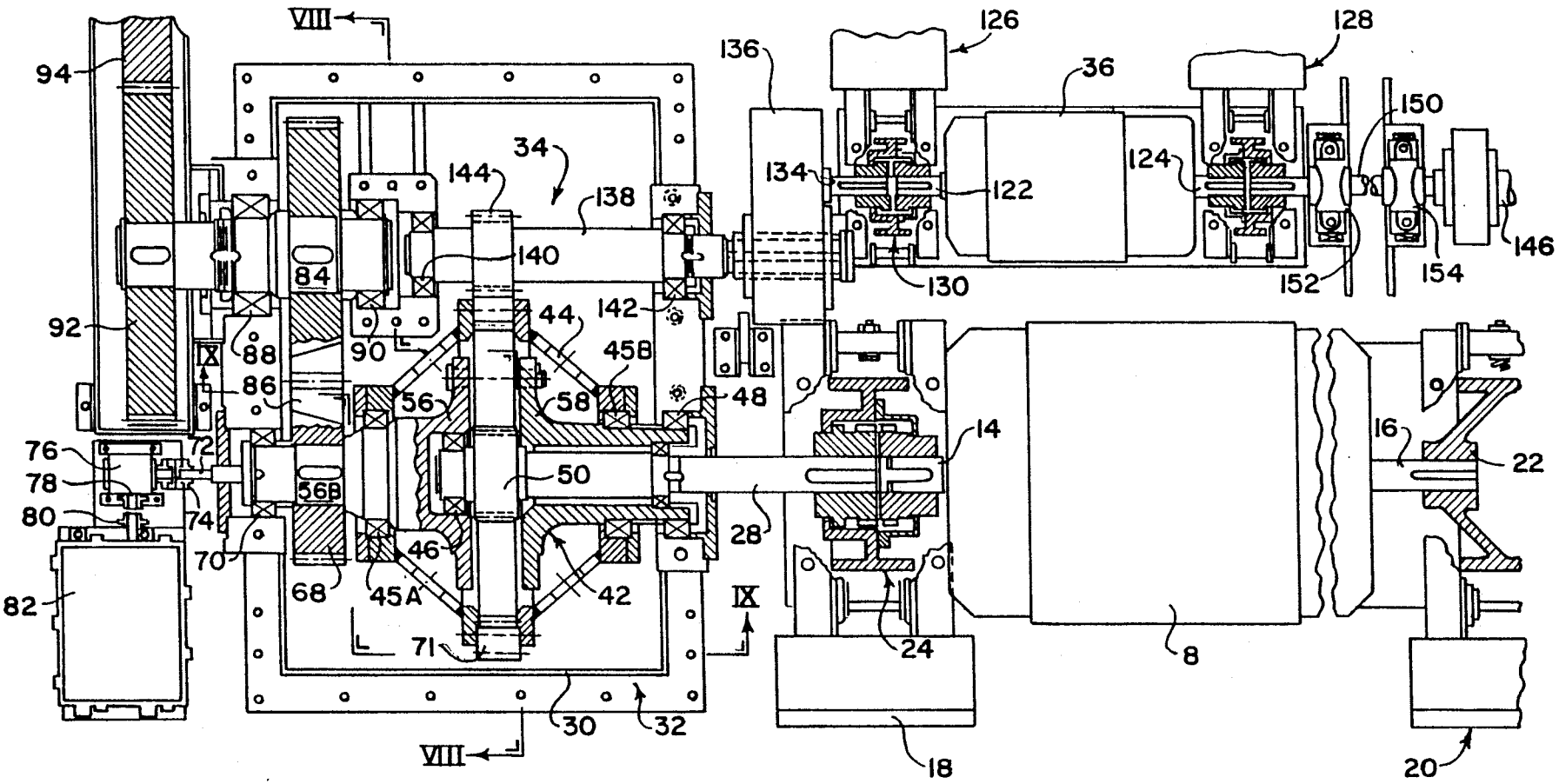
FIG. 2 is an enlarged partial section plan view of the two speed hoist drive system for a BOF sublance according to the present invention.
Figure 5:
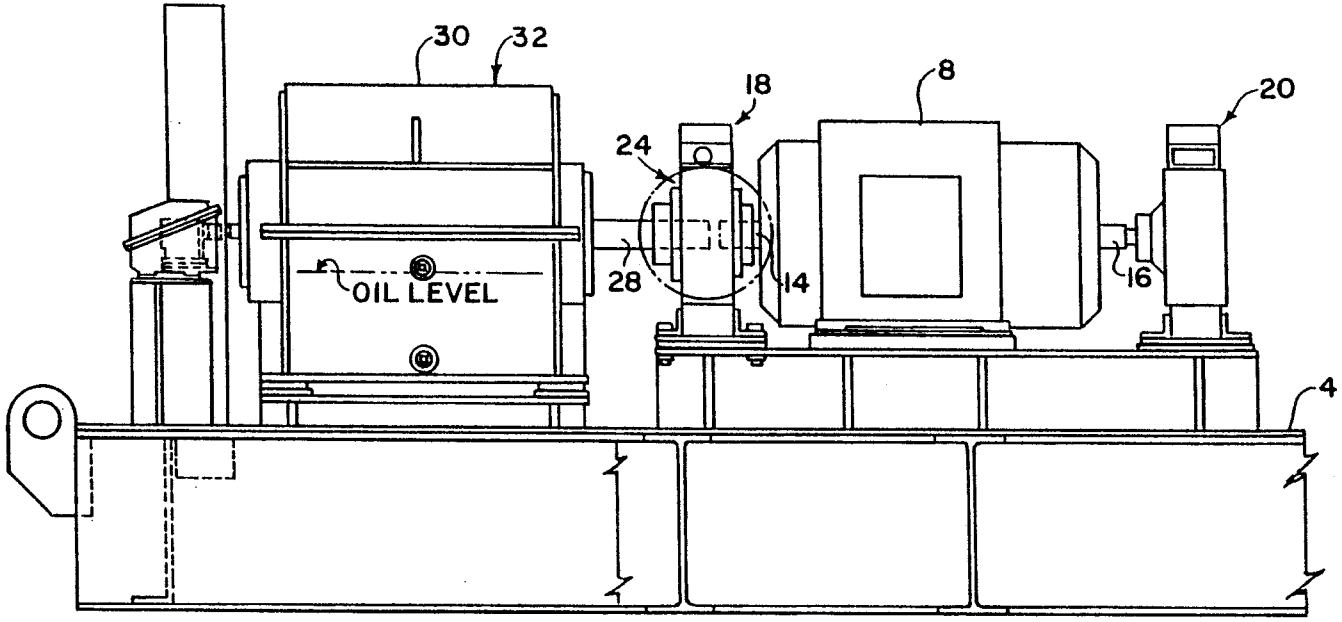
FIG. 5 is a view taken along line V—V of FIG. 1.

As seen in FIGS. 1, 2 and 5, supported atop the platform 4 is a first electric motor 8 which, through a gearing system described in greater detail hereinafter, serves to drive a sublance hoist drum 10 at relatively rapid speed to enable rapid raising and lowering of a sublance 12 (FIG. 13) through a non-critical zone above the molten metal bath B in the BOF. According to the preferred construction, motor 8 is a reversible 125 HP AC motor having an operational speed of 900 rpm, although it is contemplated that other motors of similar horsepower and operational speed may be suitably used without deleteriously affecting the performance of the two speed hoist drive system 2.

Rotatably driven by motor 8 and projecting from opposite ends thereof is a pair of shafts 14 and 16 which extend into brake assemblies 18 and 20, respectively. According to the preferred construction, brake assemblies 18 and 20 are solenoid operated brake devices that assume a non-braking position while motor 8 is powered and are spring biased into braking position when the motor is shut off. Fixedly secured to shaft 16 is a brake wheel 22 which, in the known manner, is acted upon by illustrated brake shoes of brake assembly 20. The provision of two brake assemblies at opposite ends of the motor 8 is preferred in order to assure that the shaft 14 does not rotate when the motor 8 is unpowered.

Figure 3:
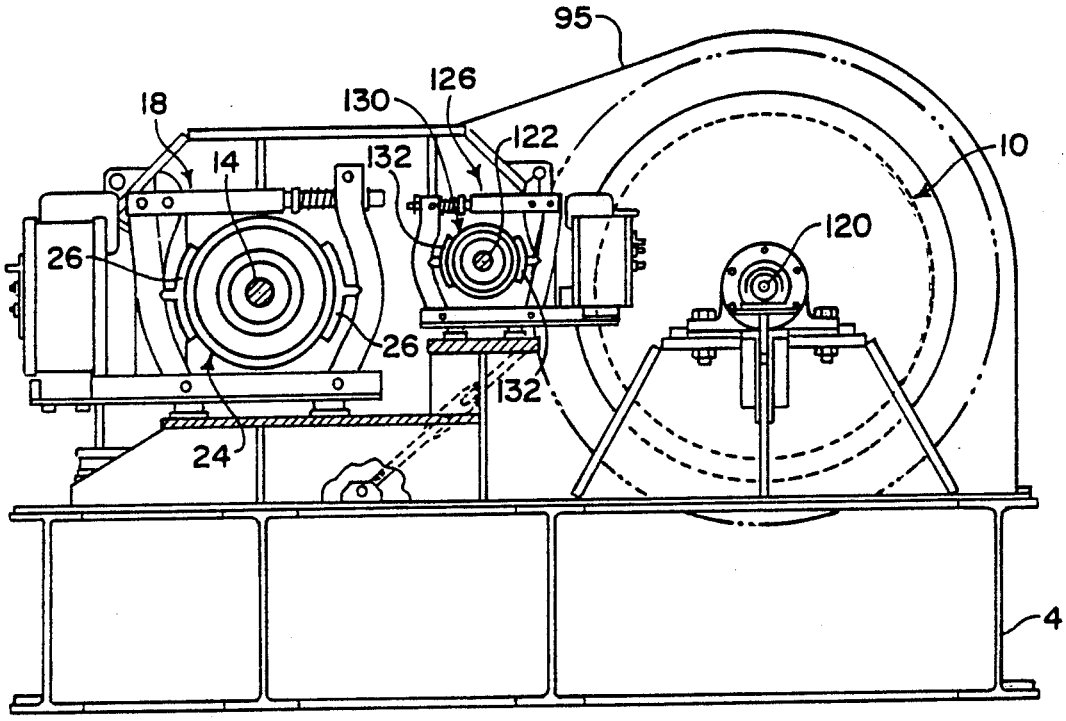
FIG. 3 is a view taken along line III—III of FIG. 1.

Through cooperation with a brake wheel coupling 24, the outer circumference of which is engageable by the brake shoes 26 of brake assembly 18 (FIG. 3) when motor 8 is shut off, the rotation of shaft 14 by motor 8 is operable so as to drivingly rotate a shaft member 28. Shaft 28, in turn, extends into a housing 30 of a power transmission means 32. Enclosed within the housing is a planetary gear system 34 so constructed as to be operable by the motor 8 or by a second smaller electric motor 36 or even a third air motor 38, each of which motors 36 and 38 as well as their connections to planetary gear system 34 will be described in greater detail hereinbelow. As is conventional, housing 30 is equipped with a breather element 40.

As seen most clearly in FIG. 2, planetary gear system 34 is comprised of a rotatable inner gear carrier 42 rotatably supported within a rotatable outer gear carrier 44 by a pair of bearings 45A and 45B. Shaft member 28 passes through and is rotatably supported within inner gear carrier 42 by spaced apart bearings 46 and 48. Fixed adjacent to the end of the shaft member 28 journaled by bearing 46 is a spur sun gear 50 which, when rotatable outer gear carrier 44 is prevented from rotating, enables motor 8 to operate drive hoist drum 10 in order to raise and lower the sublance carriage 52 (FIG. 13) at relatively rapid speed through a non-critical zone above the bath within the BOF in order to maximize productivity.

Figure 8:
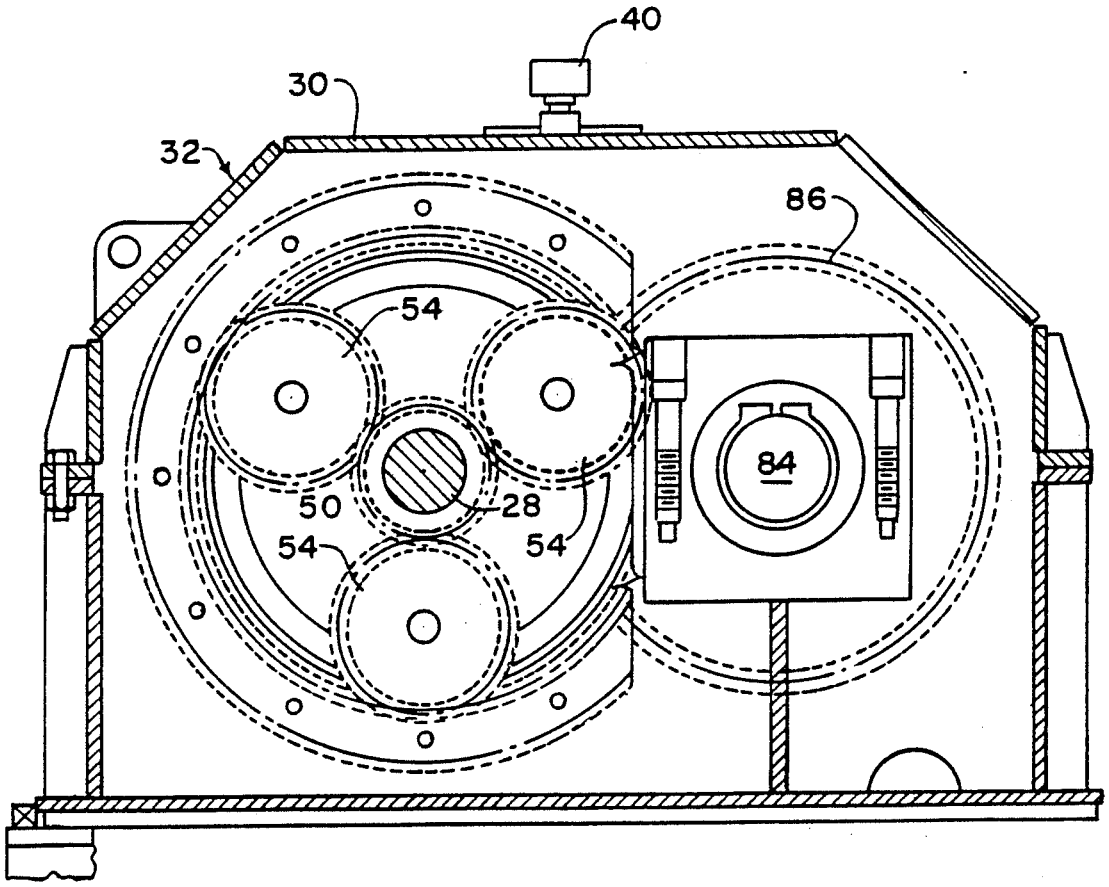
FIG. 8 is a view taken along line VIII—VIII of FIG. 2.
Figure 9:
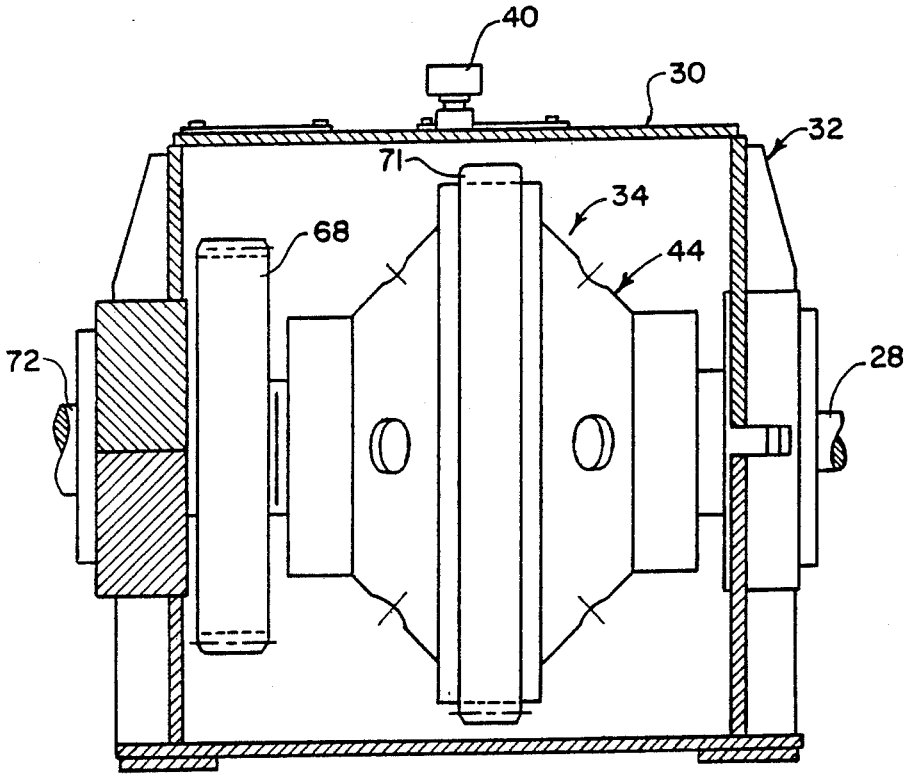
FIG. 9 is a view taken along line IX—IX of FIG. 2.
Figure 10:
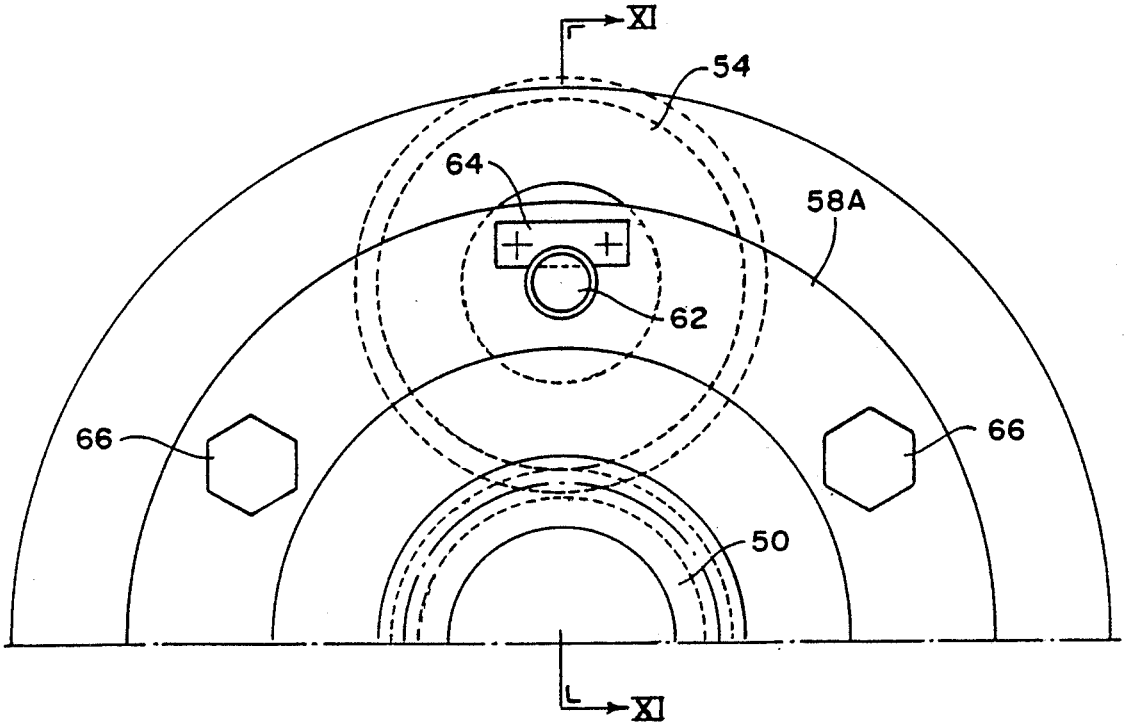
FIG. 10 is an enlarged partial elevation view of a portion of the planetary gear system of the two speed hoist drive of the present invention.
Figure 11:
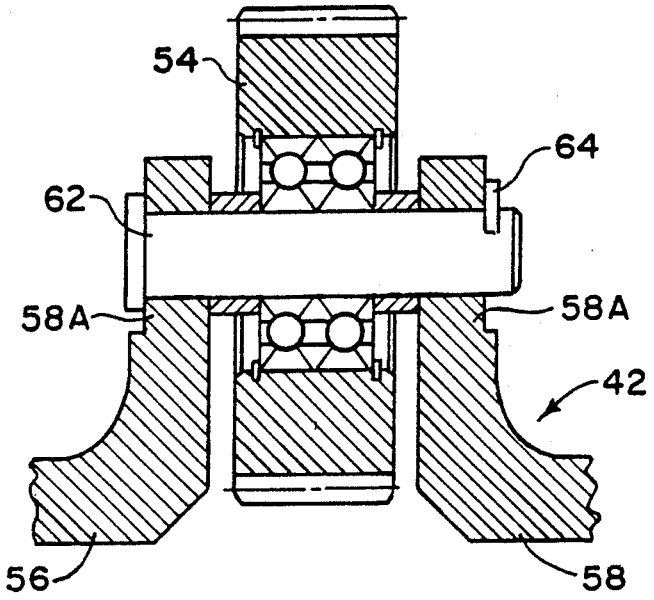
FIG. 11 is a view taken along line XI—XI of FIG. 10.

Rotatably supported by inner gear carrier 42 is a plurality of planetary spur gears 54 adapted to be driven by sun gear 50. Preferably, three such planetary gears 54 are supported by inner gear carrier 42 and equilangularly spaced about sun gear 50 in the manner depicted in FIGS. 8, 10 and 12. The mounting of the planetary gears 54 to the inner gear carrier is most clearly seen in FIGS. 10 and 11. The inner gear carrier includes opposed housing members 56 and 58 having flanged peripheral regions 56A and 58A through which are provided apertures 60 which receive therethrough the axles 62 for the planetary gears 54. The axles are retained by suitable retainer members, such as, for example, clips 64, and the housing members 56A and 58A are preferably attached to one another by bolt fasteners 66.

As will be explained in more detail hereinafter, an annular ring gear 71 carried by outer gear carrier 44 and having inner and outer circumferential toothing is held against rotation by virtue of the deactivation and braking of motor 36 while motor 8 is powered. Accordingly, when shaft 28 is turning, sun gear 50 causes: 1) rotation of the planetary spur gears 54 in a direction of rotation opposite to that of shaft 28, 2) orbiting of the planetary gears 54 about the sun gear 50 in the same direction as the rotation direction of shaft 28, and 3) rotation of the inner gear carrier 42 in the same direction as that of shaft 28.

From where it is supported by bearing 45A inner gear carrier housing member 56 tapers downwardly in diameter and assumes the form of a shaft 56B which has secured thereto a gear 68 and is rotatably journaled at a distal end thereof in a bearing 70. According to the preferred embodiment of the present invention, the planetary gear system 34 services to produce a reduction in the output speed from the first motor 8 from approximately 900 rpm in shaft 28 to approximately 200 rpm in shaft 56B.

Projecting from the distal end of shaft 56B is a relatively small diameter shaft 72 which leads to a coupling 74 which, in turn, leads to a gear reducer 76 preferably possessing a reduction ratio of approximately 40:1. Hence, when the motor 8 is in operation, the output shaft 78 from the gear reducer turns at approximately 5 rpm. Through a coupling 80 the gear reducer output shaft is joined to a cam limit switch 82, the function of which is to detect a fully lowered or a fully raised condition of the sublance carriage 52 and then cease operation of the activated hoist motor 8, 36 or 38 upon detection of either of these limit conditions, thereby preventing damage to both the sublance hardware and the hoisting system.

Figure 4:
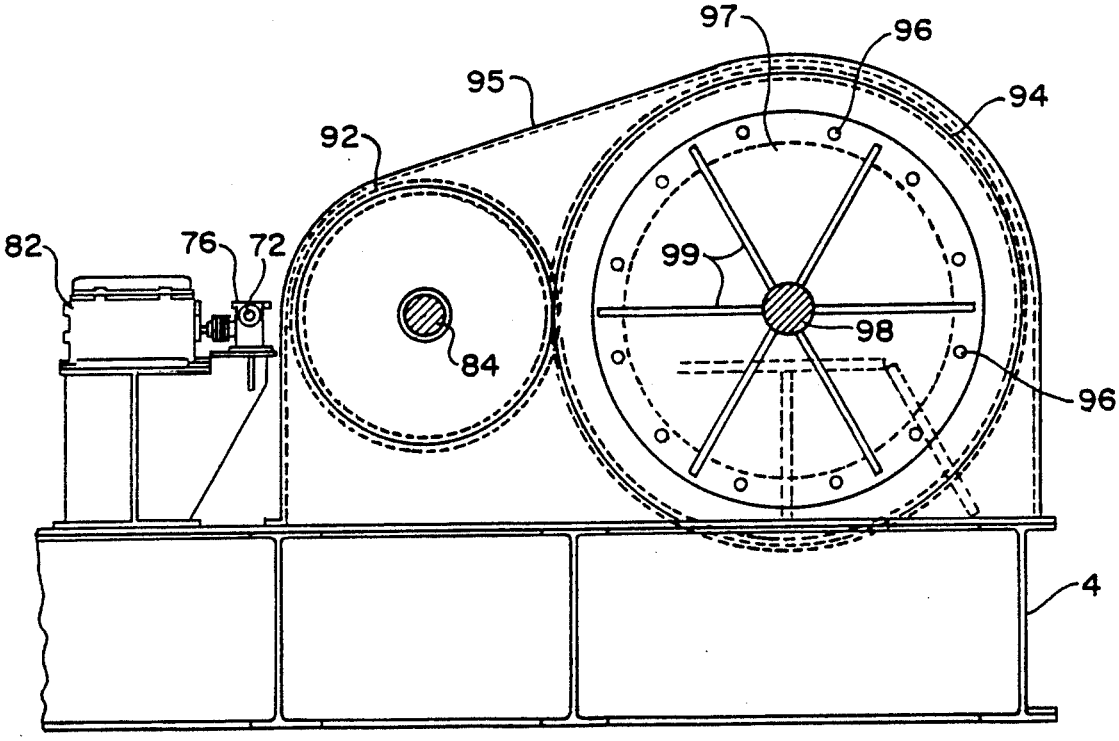
FIG. 4 is a view taken along line IV—IV of FIG. 1.
Figure 7:
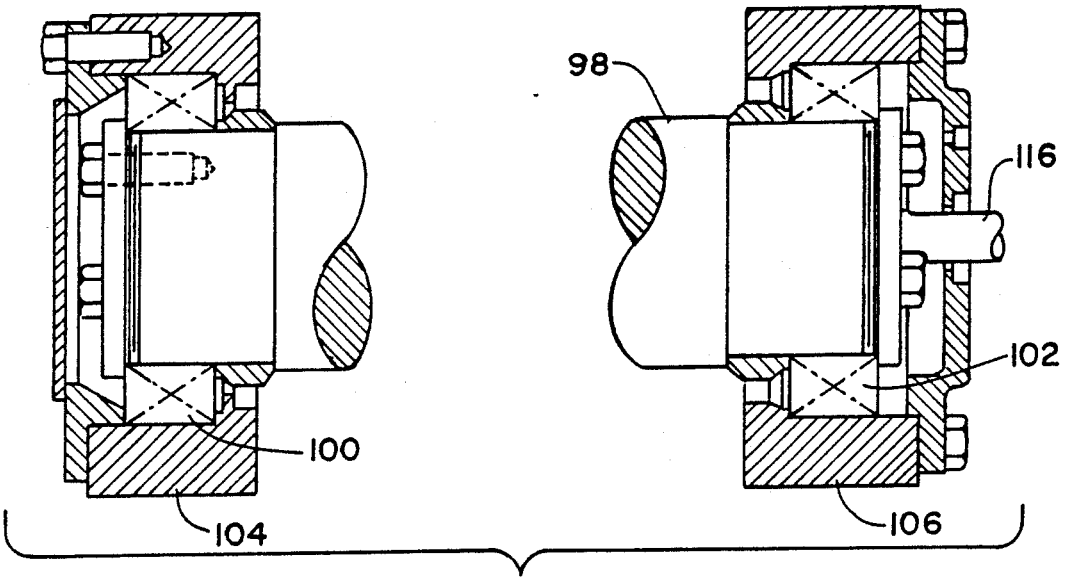
FIG. 7 is a view taken along line VII—VII of FIG. 1.

Fixedly mounted on a shaft 84 is a gear 86 which is engaged with and driven by gear 68. Shaft 84 is rotatably supported by bearings 88 and 90 at each side of gear 86. The end of shaft 84 opposite to the end thereof supported by bearing 90 carries a gear 92 which engages with and drives the hoist drum drive gear 94. Gear train 92 and 94 are for safety preferably enclosed within a housing 95. With reference to FIG. 1, it is seen that in accordance with the present invention, hoist drum drive gear 94 preferably is an annular ring gear suitably attached, e.g., as by bolt fasteners 96, to a plate 97 which is welded to the hoist drum arbor 98. The opposite ends of the arbor are rotatably supported in bearings 100 and 102 (FIG. 7) of bearing blocks 104 and 106, respectively. As seen in both FIG. 1 and FIG. 4, further according to the preferred embodiment, it is desirable that the plate 97 be strengthened by a plurality of radially directed webs joining the plate directly to a first end wall 107 of hoist drum 10.

In FIG. 13, there is shown two cables 108 and 110 attached to the hoist drum 10 for raising and lowering the sublance carriage 52 and also the sublance 12 which is clamped thereto by suitable releasable clamping means 112. The clamping means may be of any suitable type known, per se, by those of ordinary skill in this art. Since there are two separate hoisting cables entrained about hoist drum 10, the surface of the drum is preferably provided on its left half with left-handed guide grooves to receive cable 108 and on its right half with right-handed guide grooves to receive cable 110 in order to prevent tangling of the cables during rotation of the drum 10. The floor of the platform 4 is provided with an aperture 114 to permit passage the cables 108 and 110. As mentioned hereinabove, although not illustrated, the system preferably includes apparatus for slewing the platform 4 between "ready" and "standby" positions above the BOF vessel about a slewing center 115. The slewing apparatus may, for example, include a rack and pinion system for pivoting a column which supports the platform 4.

Projecting from the end of the hoist drum arbor 98 supported in bearing block 106 is a relatively small diameter shaft 116 which is joined by a coupling 118 to a resolver 120. The purpose of the resolver is to act as a device for accurately counting the revolutions of the hoist drum in order to identify the precise elevation of the sublance probe 12.

As noted previously, when motor 8 has been so operated as to rapidly lower the sublance completely through the non-critical zone above the bath in the BOF, its power is shut off and the return spring of the likewise unpowered brake assemblies 18 and 20 biases these assemblies to positively seize rotation of the shafts 14 and 16 against rotation. At such time, motor 36 is activated in order to slowly and carefully lower the sublance to a desired penetration depth within the bath, thereby effectively preventing rapid over-insertion and potential damage to the sublance by rapid thermal and/or physical shock. In accordance with the preferred embodiment of the present invention, motor 36 is a reversible 7.5 HP AC electric motor having an operational speed of 900 rpm. However, as with motor 8, it is again contemplated that other motors of similar horsepower and operational speed may be suitably used without deviating from the scope of the present invention.

The inclusion of motor 36 in the two speed hoist drive system 2 of the present invention is essential because although relatively high-horsepower electric motors such as motor 8, if variably controlled as by a rheostat, for example, may be effective when operating at high operational speeds for hoisting heavy pieces of equipment, they cannot produce sufficient torque at low operational speeds needed to raise and lower a BOF sublance apparatus and its associated materials which may typically approach weights of approximately 8,000 pounds.

Figure 6:
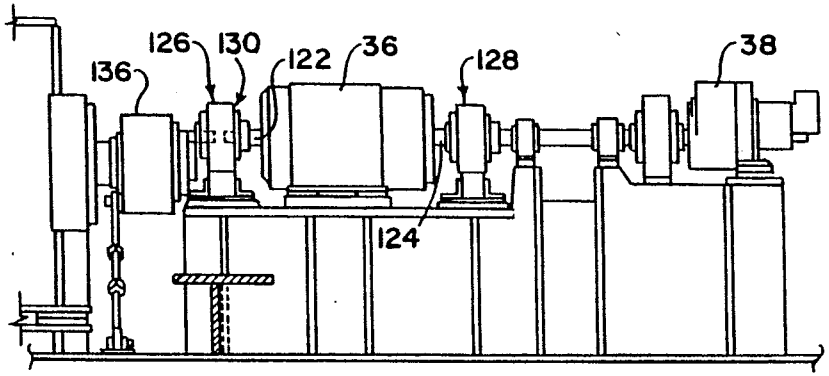
FIG. 6 is a view taken along line VI—VI of FIG. 1.

Rotatably driven by motor 36 and projecting from opposite ends thereof is a pair of shafts 122 and 124 extending into brake assemblies 126 and 128, respectively. According to the preferred embodiment illustrated in FIGS. 1, 2 and 6, brake assemblies 126 and 128 are solenoid operated brake devices that are constructed similarly but on a smaller scale than brake assembly 18. Brake assemblies 126 and 128 assume a non-braking position while motor 26 is powered and are spring biased into braking position when motor 36 is shut off. And, for reasons similar to those regarding the provision of the two brake assemblies 18 and 20 for motor 8, it is likewise preferred that two brake assemblies be provided at opposite ends of the motor 36 in order to assure that the shaft 122 does not rotate when the motor 36 is unpowered.

Through cooperation with a brake wheel coupling 130, the outer circumference of which is engageable by the brake shoes 132 of brake assembly 126 (FIG. 3) when motor 36 is shut off, the rotation of shaft 122 is operable so as to drivingly rotate a shaft member 134. Shaft 134, in turn, extends into a gear reducer 136 preferably possessing a reduction ratio of approximately 15:1. Thus, when the motor 36 is in operation, the output shaft 138 from the gear reducer 136 turns at approximately 60 rpm.

Figure 12:
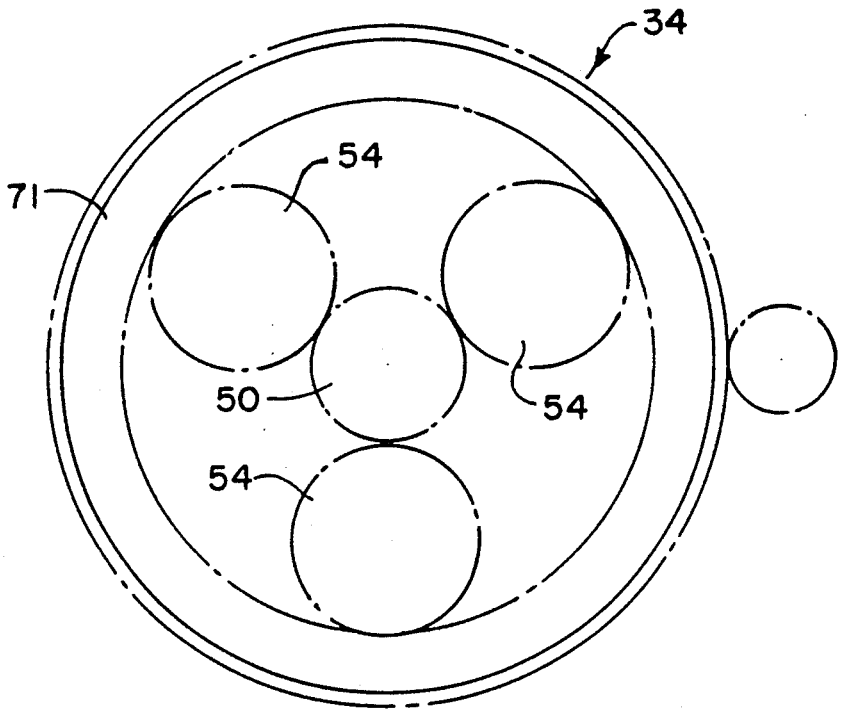
FIG. 12 is a schematic view of the planetary gear system of the two speed hoist drive of the present invention.

Shaft 138 is rotatably supported in the power transmission housing 30 by a pair of spaced apart bearings 140 and 142. Fixed to shaft 138 between bearings 140 and 142 is a tangential spur gear 144 which engages with the exterior circumferential toothing of annular ring gear 71 of the outer gear carrier 44. This arrangement is represented in FIG. 12. As noted hereinabove, when motor 36 is powered, motor 8 is unpowered, and vice versa. Hence, when motor 36 is operating, sun gear 50 is prevented from turning by virtue of the braking action occurring at brake assemblies 18 and 20. Thus, when shaft 122 is turning, ring gear 71 and the outer gear carrier 44 are also rotated through the engagement between the teeth of gears 144 and 71, thereby causing: 1) rotation of the ring gear 71 and the planetary spur gears 54 in a direction opposite to that of gear 144, 2) orbiting of the planetary gears 54 about the sun gear 50 opposite to the direction of rotation of gear 144, and 3) rotation of the inner gear carrier 42 in a direction opposite to that of the rotation direction of gear 144. And, once the inner gear carrier 42 is turning, the remainder of the gear train leading to the hoist drum 10 operates as described supra. When the second motor 36 is operating, the reduction in the output speed from the second motor is from approximately 900 rpm in shaft 122 to approximately 10 rpm in shaft 56B. Thus, the planetary gear system output speed attained through operation of motor 36 is about one-twentieth of that produced by operation of motor 8.

Therefore, in accordance with the preferred embodiment of the two speed sublance hoist drive of the present invention, the planetary gear system 34 is capable of being operated by either motor 8 or motor 36, so that the sublance 12 can be hoisted rapidly in the aforedescribed non-critical zone for maximum productivity and slowly in the critical spotting zone for maximum safety and accuracy.

In the event of an electrical power failure, it is possible to turn hoist drum 10 through activation of a third motor 38 and manual release of brake assemblies 126 and 128. Air motor 38 is preferably a motor which closely replicates the horsepower and operational speed of electric motor 36. That is to say, it is most preferred that air motor 38 possess roughly 7 to 8 horsepower and able to operate at a speed of approximately 900 rpm in order to substantially simulate the hoisting speed of motor 36.

A shaft 146 leads from air motor 38 to a clutch coupling 148 whereat it is drivingly connected to a shaft 150 which is rotatably supported in spaced apart bearing blocks 152 and 154 and which extends into brake assembly 128. Should an electrical power failure occur, brake assemblies 126 and 128 are released, the motor 38 is activated through connection with an appropriate pressurized air source, and sublance 12 is raised at essentially the same speed as it would be by operation of electric motor 38.

Also shown in FIGS. 1 and 13 is a cable tension sensing device 156 to which is attached the hoist cables 108 and 110. In the event that slack is detected in cable 108 and/or 110, a limit switch within sensing device 156 is tripped which may either halt rotation of hoist drum 10 or trigger means for instantaneously seizing the sublance carriage 52 in order to prevent free fall thereof.

It is further contemplated that the sequential operation of the aforesaid hoisting motors may be either manually or automatically controlled.

For the purpose of simplification of disclosure, specific numerical identification and accompanying written description of obligatory hardware, i.e., particulars of most of the shaft bearing blocks, bracket elements required for mounting the major structural components to platform 4, and the like, has been omitted. It will be understood, however, that these various pieces of hardware are of conventional construction. Therefore, specific description thereof is believed to be superfluous for understanding of the instant invention by one of ordinary skill in this art.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A basic oxygen furnace sublance hoist system, said system comprising:

a platform adapted for positioning above a basic oxygen furnace vessel;

means carried by said platform for suspending said sublance;

a first motor means carried by said platform for hoisting said sublance at a first speed through a region above a metal bath contained within said basic oxygen furnace vessel;

a second motor means carried by said platform for hoisting said sublance at a second speed for insertion and withdrawal of said sublance into and from said metal bath, said second speed being less than said first speed; and means operable by said first and second motor means for transmitting power to said means for suspending to enable hoisting of said sublance by said first and second motor means.

2. The system of claim 1 wherein said first motor means and said second motor means are electric motors.

3. The system of claim 1 wherein said means for transmitting power comprise a planetary gear system.

4. The system of claim 3 wherein said planetary gear system includes a rotatable inner gear carriage and a rotatable outer gear carriage surrounding said inner gear carriage.

5. The system of claim 4 further comprising a sun gear, a plurality of planetary gears rotatably supported by said inner gear carriage for orbital engagement with said sun gear, a ring gear having inner and outer circumferential toothing supported by said outer gear carriage, and a tangential gear, said inner circumferential toothing being engaged by said planetary gears and said outer circumferential toothing being engaged by said tangential gear.

6. The system of claim 5 further comprising means connecting said first motor means with said sun gear for enabling driving of said sun gear by said first motor means and means connecting said second motor means with said tangential gear for enabling driving of said tangential gear by said second motor means.

7. The system of claim 6 further comprising means for preventing rotation of said means connecting said first motor means with said sun gear when said second motor means is operating and means for preventing rotation of said means connecting said second motor means with said tangential gear when said first motor means is operating.

8. The system of claim 7 wherein each of said means for preventing rotation comprise at least one solenoid actuated brake.

9. The system of claim 1 wherein said means for suspending said sublance comprise a hoist drum and hoist cable means attached to said hoist drum for winding and unwinding thereabout in order to raise and lower said sublance.

10. The system of claim 9 further comprising a sublance carriage connected to said hoist cable means, said sublance carriage including means for releasably gripping said sublance.

11. The system of claim 9 further comprising means for precisely determining the elevation of said sublance.

12. The system of claim 11 wherein said means for precisely determining the elevation of said sublance comprise resolver means operably connected to said hoist drum for counting revolutions thereof.

13. The system of claim 9 further comprising means for detecting abnormal tension in said hoist cable means.

14. The system of claim 2 further comprising a third motor means carried by said platform for hoisting said sublance substantially at said second speed, said third motor means serving as a substitute for said second motor means in the event of an electrical power failure, said means for transmitting power to said means for suspending being also operable by said third motor means.

15. The system of claim 14 wherein said third motor means is an air motor.

16. A method for hoisting a basic oxygen furnace sublance, said method comprising the steps of:

activating a first sublance hoist motor to operate a power transmission device connected to means for suspending said sublance in order to hoist said sublance at a first speed through a region above a metal bath contained within a basic oxygen furnace vessel; and activating a second sublance hoist motor to operate said power transmission device in order to hoist said sublance into and from said metal bath at a second speed less than said first speed.

17. The method of claim 16 further comprising deactivating said first motor prior to activating said second motor and deactivating said second motor prior to activating said first motor.

18. The method of claim 16 further comprising activating a third sublance hoist motor to operate said power transmission device in order to hoist said sublance substantially at said second speed in the event of failure of said second motor.

* * * * *